US011793691B2

(12) United States Patent
Saito

(10) Patent No.: US 11,793,691 B2
(45) **Date of Patent: *Oct. 24, 2023**

(54) SINGLE-HANDEDLY OPERABLE WHEELCHAIR

(71) Applicant: RESEARCH INSTITUTE FOR LIFE SPACE, LLC, Sapporo (JP)

(72) Inventor: Toru Saito, Sapporo (JP)

(73) Assignee: RESEARCH INSTITUTE FOR LIFE SPACE, LLC

( * ) Notice: Subject to any disclaimer, the term of this patent is extended or adjusted under 35 U.S.C. 154(b) by 0 days.

This patent is subject to a terminal disclaimer.

(21) Appl. No.: 18/201,758

(22) Filed: May 25, 2023

(65) Prior Publication Data

US 2023/0293366 A1 Sep. 21, 2023

Related U.S. Application Data

(63) Continuation of application No. PCT/JP2021/034281, filed on Sep. 17, 2021.

(30) Foreign Application Priority Data

Dec. 16, 2020 (JP) ..... 2020-208152

(51) Int. Cl.
*A61G 5/02* (2006.01)

(52) U.S. Cl.
CPC ..... *A61G 5/02* (2013.01)

(58) Field of Classification Search
CPC ..... A61G 5/02
See application file for complete search history.

(56) References Cited

U.S. PATENT DOCUMENTS 2,431,112 A * 11/1947 Everest ..... A61G 5/02 280/211
3,770,073 A * 11/1973 Meyer ..... A61G 5/047 180/385

(Continued)

FOREIGN PATENT DOCUMENTS

JP S46-13386 U 5/1971
JP 2004-141452 A 5/2004

(Continued)

OTHER PUBLICATIONS

International Search Report for PCT/JP2021/034281 dated Nov. 9, 2021.
PCT written opinion dated Nov. 9, 2021.

*Primary Examiner* — Minnah L Seoh
*Assistant Examiner* — Hosam Shabara
(74) *Attorney, Agent, or Firm* — Yokoi & Co., U.S.A.; Toshiyuki Yokoi

(57) ABSTRACT

Provided is a lightweight and inexpensive wheelchair that can be easily operated with either a right or left hand. The wheelchair according to the present invention is provided with; a pair of handrims having a first portion and a second portion; a drive mechanism for transmitting a first rotational force generated by the first portion on one side to a wheel on another side, and for transmitting a second rotational force generated by the first portion on the other side to a wheel on the one side, wherein the drive mechanism includes an axle on the one side, an axle on the other side connected to the axle on the one side via a rotary shaft, a first two-way clutch located on the axle on the one side, and a second two-way clutch located on the axle on the other side.

2 Claims, 16 Drawing Sheets

(56) References Cited

U.S. PATENT DOCUMENTS

| | | | | |
|---|---|---|---|---|
| 5,112,072 | A * | 5/1992 | Korosue | A61G 5/02 280/270 |
| 5,241,876 | A * | 9/1993 | Mathis | A61G 5/025 135/66 |
| 5,306,035 | A * | 4/1994 | Counts | A61G 5/0825 280/270 |
| 6,279,934 | B1 * | 8/2001 | Womack | A61G 5/0825 280/250.1 |
| 7,959,176 | B2 * | 6/2011 | Bidwell | B60B 35/14 280/250.1 |
| 8,616,573 | B1 * | 12/2013 | Storch | F16H 48/22 280/250.1 |
| 11,141,329 | B2 | 10/2021 | Saito | |
| 11,191,682 | B2 | 12/2021 | Saito | |
| 2009/0039612 | A1 | 2/2009 | Bidwell et al. | |
| 2014/0232085 | A1 * | 8/2014 | Hsiao-Wecksler | A61G 5/023 280/250.1 |
| 2021/0128376 | A1 * | 5/2021 | Saito | A61G 5/048 |

FOREIGN PATENT DOCUMENTS

| | | | |
|---|---|---|---|
| JP | 2010-279666 | A | 12/2010 |
| JP | 5105256 | B | 12/2012 |
| JP | 6288746 | B | 3/2018 |
| JP | 2019-58303 | A | 4/2019 |
| JP | 2020-11028 | A | 1/2020 |
| JP | 6742493 | B | 8/2020 |

* cited by examiner

SINGLE-HANDEDLY OPERABLE WHEELCHAIR

CROSS-REFERENCES TO RELATED APPLICATIONS

This application claims the benefit of priority and is a Continuation application of the prior International Patent Application No. PCT/JP2021/034281, with an international filing date of Sep. 17, 2021, which designated the United States, and is related to the Japanese Patent Application No. 2020-208152, filed Dec. 16, 2020, the entire disclosures of all applications are expressly incorporated by reference in their entirety herein.

BACKGROUND OF THE INVENTION

1. Field of the Invention

The present invention generally relates to a manual wheelchair (hereinafter, simply referred to as a "wheelchair"). More specifically, the present invention relates to a lightweight and inexpensive wheelchair that can be easily operated by either a right or left hand.

2. Description of Related Art

A wheelchair is configured so that a wheelchair user (hereinafter, simply referred to as a "user") operates right and left wheels by his/her hands to move forward, backward, right turn, and left turn. However, it is difficult for a person with a disability on either the right or left side of the body to use a general wheelchair because they cannot use both hands freely. Therefore, a single-hand-operated wheelchair that can be operated with only a healthy hand, even if the right or left body is disabled, has been proposed (see Patent Document 1). The wheelchair described in Patent Document 1 is configured such that the wheelchair disposes a double handrim outside a wheel on a side, where a healthy half of the body of a user is located so that the movement of the wheelchair can be controlled by operating the handrim with the healthy hand.

On the other hand, a wheelchair has also been proposed in which a rotary shaft connecting right and left wheels and an operating device such as a lever and a clutch are interlocked, and these operating devices are operated by a single hand to control the wheelchair as desired (see Patent Documents 2 to 4). Further, the wheelchairs described in Patent Documents 5 and 6 were developed by the present inventor and have a feature that can be easily operated by either a right or left hand.

Patent Document 1: Japanese Examined Utility Model Application Publication No. 46-13386

Patent Document 2: Japanese Unexamined Patent Application Publication No. 2004-141452

Patent Document 3: Japanese Unexamined Patent Application Publication No. 2010-279666

Patent Document 4: Japanese Patent No. 5105256

Patent Document 5: Japanese Patent No. 6288746

Patent Document 6: Japanese Patent No. 6742493

BRIEF SUMMARY OF THE INVENTION

However, the wheelchair described in Patent Document 1 is not convenient for wheelchair users, because the handrim for operation is disposed on only one side of the right and left sides, and the operable side is predetermined. For this reason, there is an issue that two types of operation, both right and left, have to be manufactured, which contributes to high costs. Further, the wheelchair described in Patent Document 2 requires the operation of a lever, and the wheelchair described in Patent Document 3 requires a user to tilt his/her body to the right or left during operation, which is a physical burden. There was an issue that the physical burden was excessive. Also, the wheelchair described in Patent Document 4 has an issue in that the configuration corresponding to the constant speed movement is not shown, and the usability is not good. Furthermore, although the wheelchairs described in Patent Documents 5 and 6 are fortunately well received, the former has a relatively large number of portions, so there is an improvement in that the weight of the wheelchair is slightly heavier. As for the latter, there is an improvement in that it takes time and effort depending on the operation because it is not possible to turn only the wheel on the opposite side with a single hand.

The present invention has been developed given such a situation, and the objective of the present invention is to provide a lightweight and inexpensive wheelchair that can be easily operated by either a right or left hand.

According to claim 1 of the present application, the present invention provides a single-handedly operable wheelchair having a frame, a right wheel and a left wheel, a right caster and a left caster, a seat, and a pair of right and left circular cross-sectional handrims concentrically disposed with an axle of each wheel, the wheelchair including: each of the handrims formed as separate bodies, and having a first portion located at an inner lower portion of the circular cross-section and a second portion occupying a portion other than the first portion of the circular cross-section; the first portion connected to handrim spokes; the second portion connected to a base of each wheel; and a drive mechanism for transmitting a first rotational force generated by the first portion of the handrim on one side to the wheel on another side, and for transmitting a second rotational force generated by the first portion of the handrim on the other side to the wheel on the one side. A third rotational force generated by the second portion of the handrim on the one side and/or the other side is transmitted to the wheel on the corresponding side. The drive mechanism has the axle on the one side connected to the handrim spokes on the one side, the axle on the other side connected to the axle on the one side via a rotary shaft and connected to the handrim spokes on the other side, a first two-way clutch disposed on the axle on the one side, and a second two-way clutch disposed on the axle on the other side. The first two-way clutch is configured to transmit the second rotational force to the wheel on the one side, is configured not to transmit the first rotational force to the axle on the one side, and is configured not to transmit the third rotational force generated by the second portion of the handrim on the one side to the axle on the one side. Further, the second two-way clutch is configured to transmit the first rotational force to the wheel on the other side, is configured not to transmit the second rotational force to the axle on the other side, and is configured not to transmit the third rotational force generated by the second portion of the handrim on the other side to the axle on the other side.

According to claim 2 of the present application, regarding the wheelchair of claim 1, the present invention provides the single-handedly operable wheelchair, wherein a first key provided on the outer end of the axle on the one side is installed on a first receiving portion rotatably attached to the outer end of the axle on the one side, and is engaged with a first key groove wider than the first key. A second key provided on the outer end of the axle on the other side is installed on a second receiving portion rotatably attached to the outer end of the axle on the other side, and is engaged with a second key groove wider than the second key. By rotating the receiving portion connected to the handrim spokes on the corresponding side and had a control plate with a notch, the rotational force from the handrim spokes on the corresponding side is transmitted to the axle on the corresponding side. The first two-way clutch has first rollers for cutting off transmission of the first rotational force or for carrying out transmission of the second rotational force between the axle on the one side and the wheel on the one side, and has a first retainer for retaining the first rollers at a predetermined location. The second two-way clutch has second rollers for cutting off transmission of the second rotational force or for carrying out transmission of the first rotational force between the axle on the other side and the wheel on the other side, and has a second retainer for retaining the second rollers at a predetermined location. By rotating the control plate by rotating the first receiving portion, and by rotating the first retainer by engaging the notch with a protrusion provided on the first retainer, the first rotational force is not transmitted from the axle on the one side to the wheel on the one side without locking the rotation of the first rollers, and the first rotational force is transmitted from the axle on the other side to the wheel on the other side. Further, by rotating the control plate by rotating the second receiving portion, and by rotating the second retainer by engaging the notch with a protrusion provided on the second retainer, the second rotational force is not transmitted from the axle on the other side to the wheel on the other side without locking the rotation of the second rollers, and the second rotational force is transmitted from the axle on the one side to the wheel on the one side.

According to an embodiment of the present invention, there is provided a wheelchair capable of performing moving control by simple operation using only either hand. In the wheelchair according to the embodiment of the present invention, a handrim is divided into a plurality of portions, and it is not necessary to change the way of grasping the handrim so that it is easy to use. Further, the wheelchair can be manufactured at light weight and low cost because the number of portions is small.

The wheelchair according to the embodiment of the present invention can even be used by anyone other than a person with a disability on either the right or left side of the body. That is, the wheelchair according to the embodiment of the present invention is useful when a person who has healthy both hands moves in the wheelchair with an article (smartphone, tableware, umbrella, or the like) in a single hand. It is also useful when playing sports such as tennis or basketball in the wheelchair. Further, as will be described in detail later, the wheelchair according to the embodiment of the present invention is useful compared to a conventional both-hands-wheelchair, in that it can be used for an uphill movement while resting according to the physical strength of the user.

DETAILED DESCRIPTION OF THE INVENTION

Figure 1:
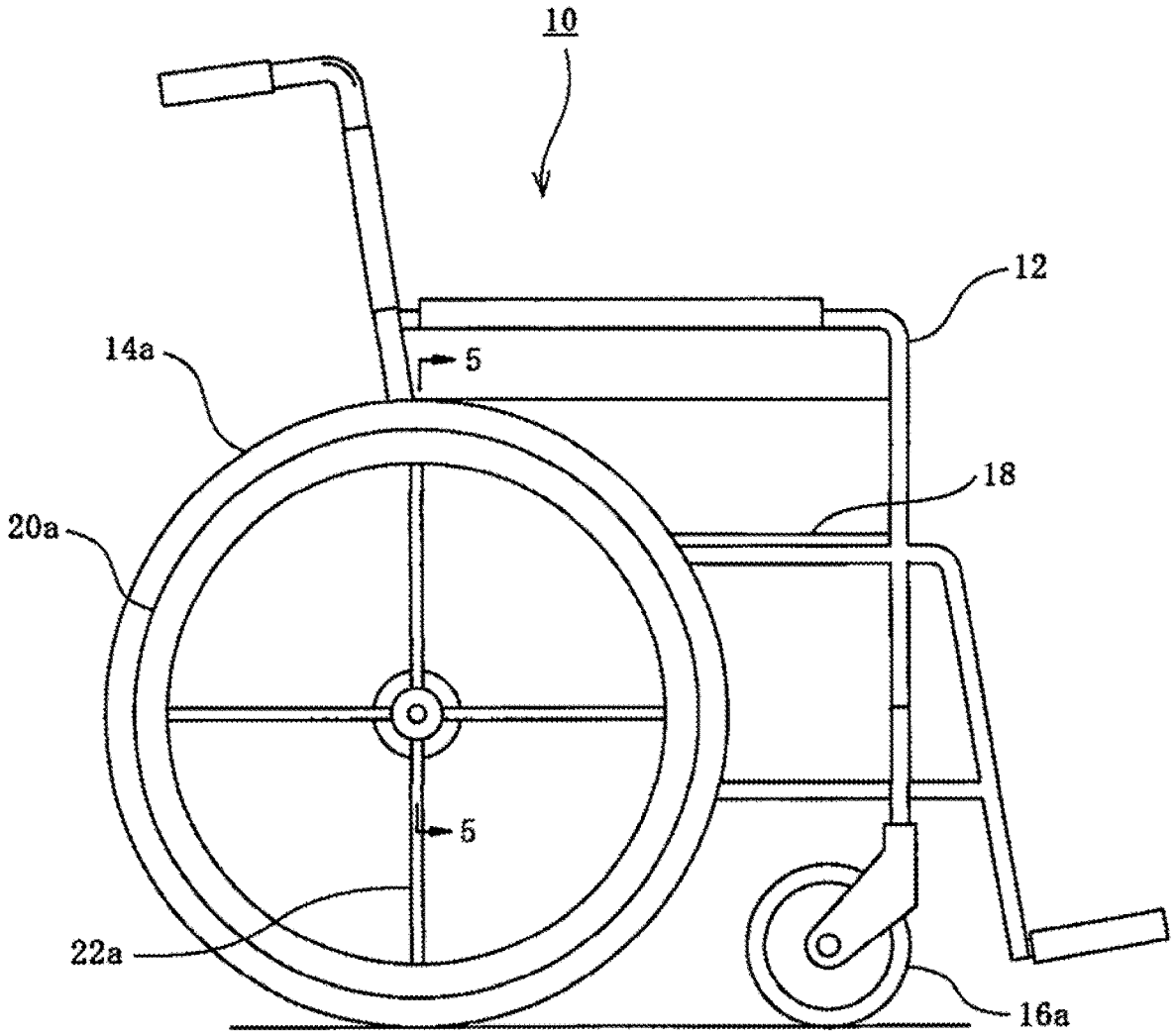
FIG. 1 is a right side view showing a wheelchair, according to an embodiment of the present invention.
Figure 2:
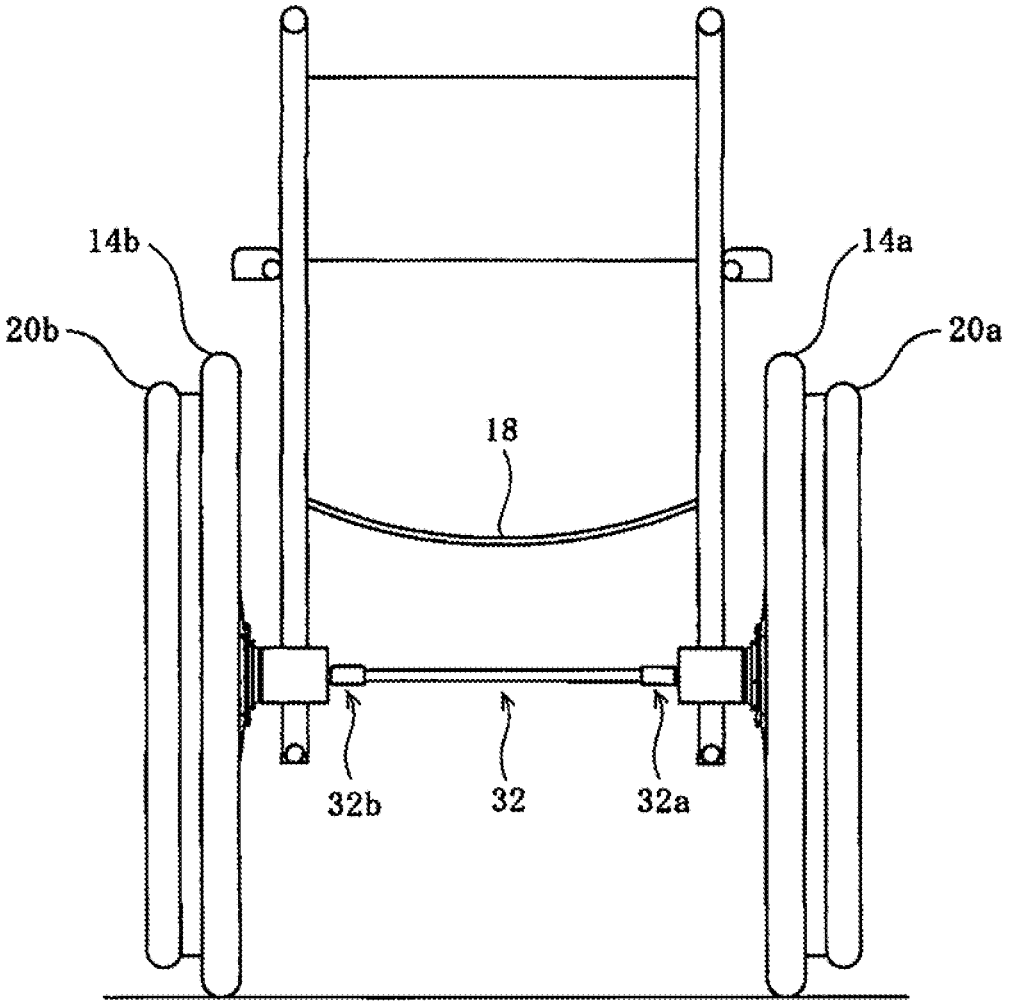
FIG. 2 is a rear view of the wheelchair of FIG. 1.

Next, a wheelchair, according to an embodiment of the present invention, will be described in detail with reference to the drawings. FIG. 1 is a right side view showing the wheelchair, according to the embodiment of the present invention. FIG. 2 is a rear view of the wheelchair shown in FIG. 1.

According to the embodiment of the present invention, as shown by a reference numeral 10 as a whole in FIG. 1, the wheelchair has a frame 12 forming a skeleton of the wheelchair, a right wheel 14*a* and a left wheel 14*b*, a pair of casters 16*a* and 16*b*, and a seat 18. The wheelchair 10 is symmetrical concerning its centerline, and has the same component on each of the right and left sides. In the following description, "a" is attached to the reference symbol of the component located on the right side of the wheelchair 10, and "b" is attached to the reference symbol of the component located on the left side of the wheelchair 10. Hereinafter, the configuration of the right side portion of the wheelchair 10 will be mainly described.

Figure 3A:
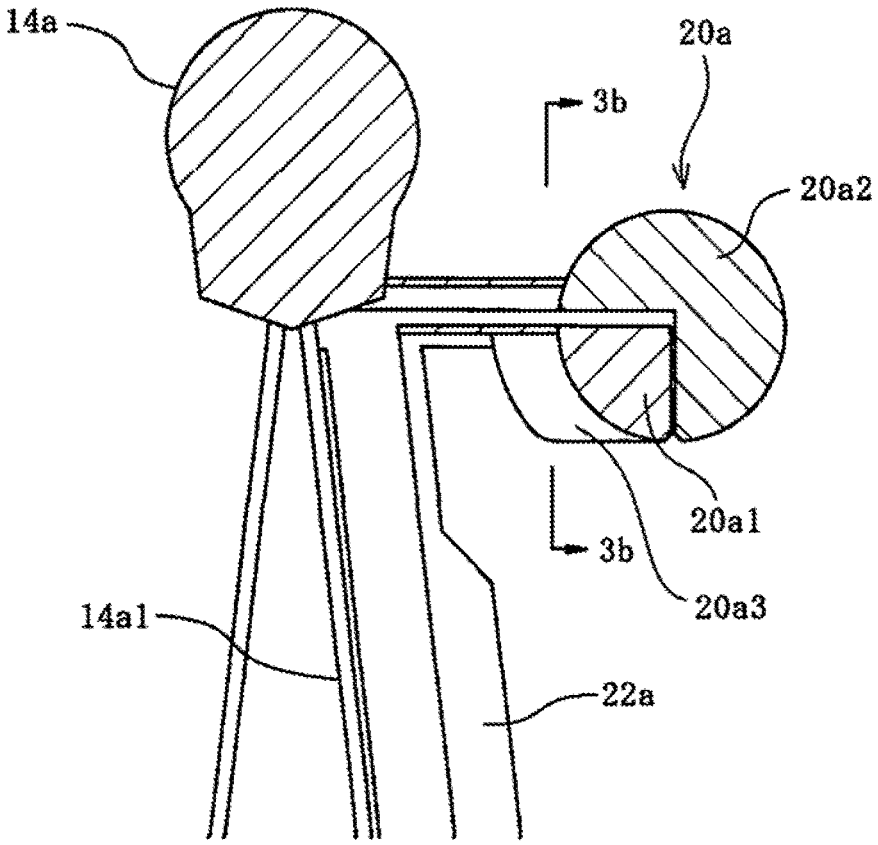
FIG. 3A is a view showing a cross-section of a handrim.

The wheelchair 10 also has a handrim 20*a* disposed concentrically of an axle 24*a* of the right wheel 14*a*. As shown in FIG. 3A, the handrim 20*a* has two portions, that is, a first portion 20*a*1 located at an inner lower portion of the circular cross-section, and a second portion 20*a*2 occupying a portion other than the first portion 20*a*1 of the circular cross-section. The first portion 20*a*1 and the second portion 20*a*2 are formed as separate bodies. As a result, when a user grasps the handrim 20*a*, fingertips of fingers other than a thumb abut the first portion 20*a*1, and the thumb and palm abut the second portion 20*a*2. The portion intended by the user (only the first portion 20*a*1, only the second portion 20*a*2, or both the first portion 20*a*1 and the second portion 20*a*2) can be operated. In the specification, "inward" means a side where the user sitting in the wheelchair is located, and "outward" means the opposite side to the side where the user is located.

Figure 3B:
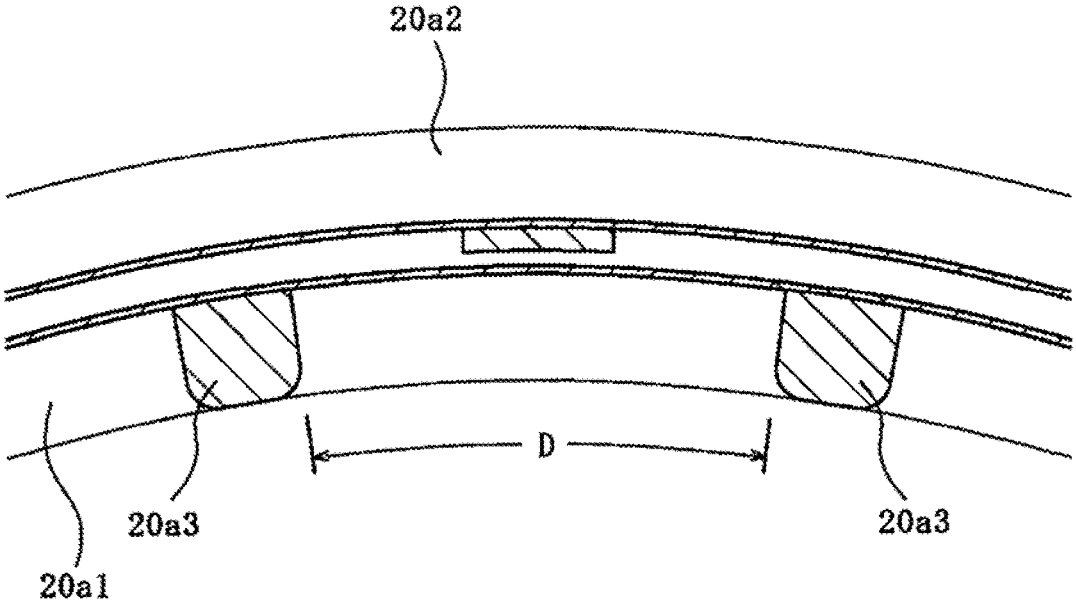
FIG. 3B is a view taken along line 3*b*-3*b* of FIG. 3A.

As shown in FIGS. 3A and 3B, the handrim 20*a* is provided with a plurality of convex portions 20*a*3 arranged regularly at a predetermined interval D on the outer surface of the first portion 20*a*1 to improve the grasp of the fingers. The predetermined distance D is selected so that three fingers from the index finger to the ring finger are included. When the first portion 20*a*1 is grasped, the side of the index finger or the side of the ring finger abuts the convex portion 20*a*3 so that the rotational force can be easily transmitted to the first portion 20*a*1. By providing the convex portion 20*a*3 on the first portion 20*a*1, there is an effect that the user can easily grasp the first portion 20*a*1 with fingers.

The first portion 20*a*1 of the handrim 20*a* is connected to handrim spokes 22*a*, and the second portion 20*a*2 is connected to a base of the right wheel 14*a*.

Figure 4A:
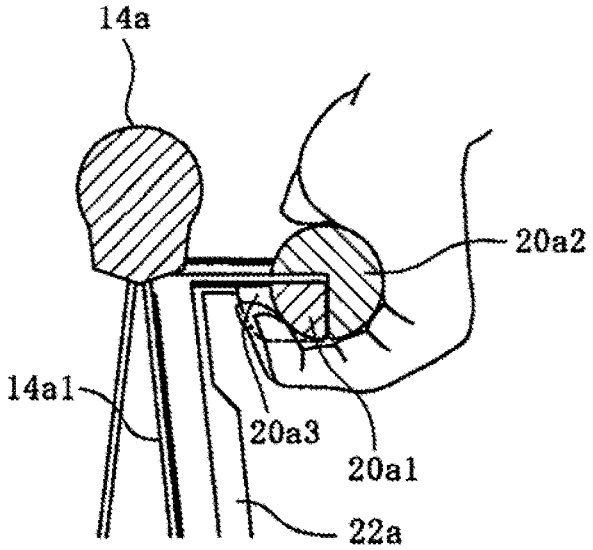
FIG. 4A is a view showing a state in which both a first portion and a second portion of the handrim are grasped by the right hand.
Figure 4B:
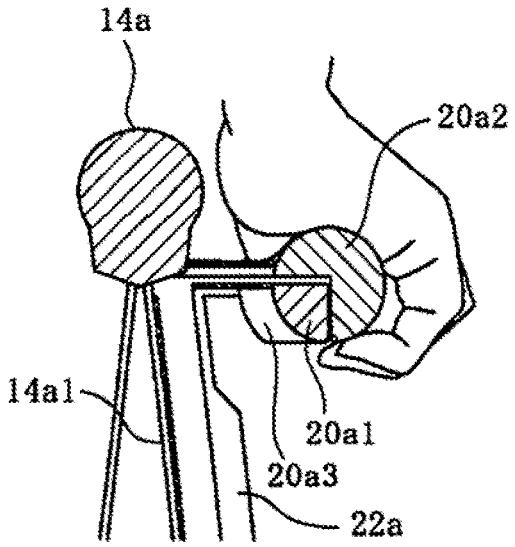
FIG. 4B is a view showing a state in which the second portion of the handrim is grasped by the right hand.
Figure 4C:
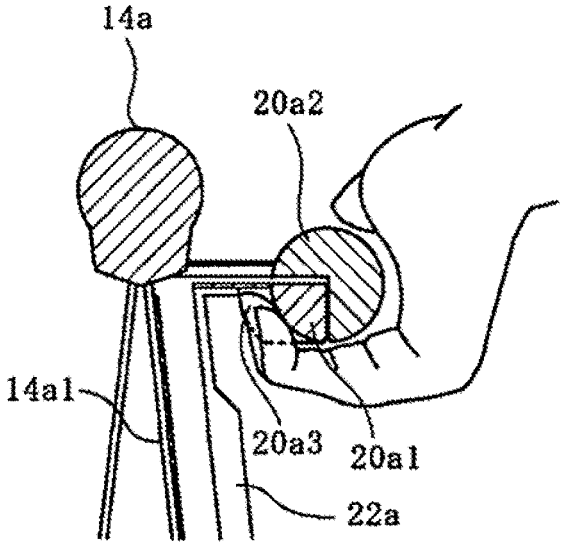
FIG. 4C is a view showing a state in which the first portion of the handrim is grasped by the right hand.

FIG. 4A shows a state in which both the first portion 20*a*1 and the second portion 20*a*2 of the handrim 20*a* are grasped by the right hand, FIG. 4B shows a state in which only the second portion 20*a*2 is grasped by the right hand, and FIG. 4C shows a state in which only the first portion 20*a*1 is grasped by the right hand.

Figure 5:
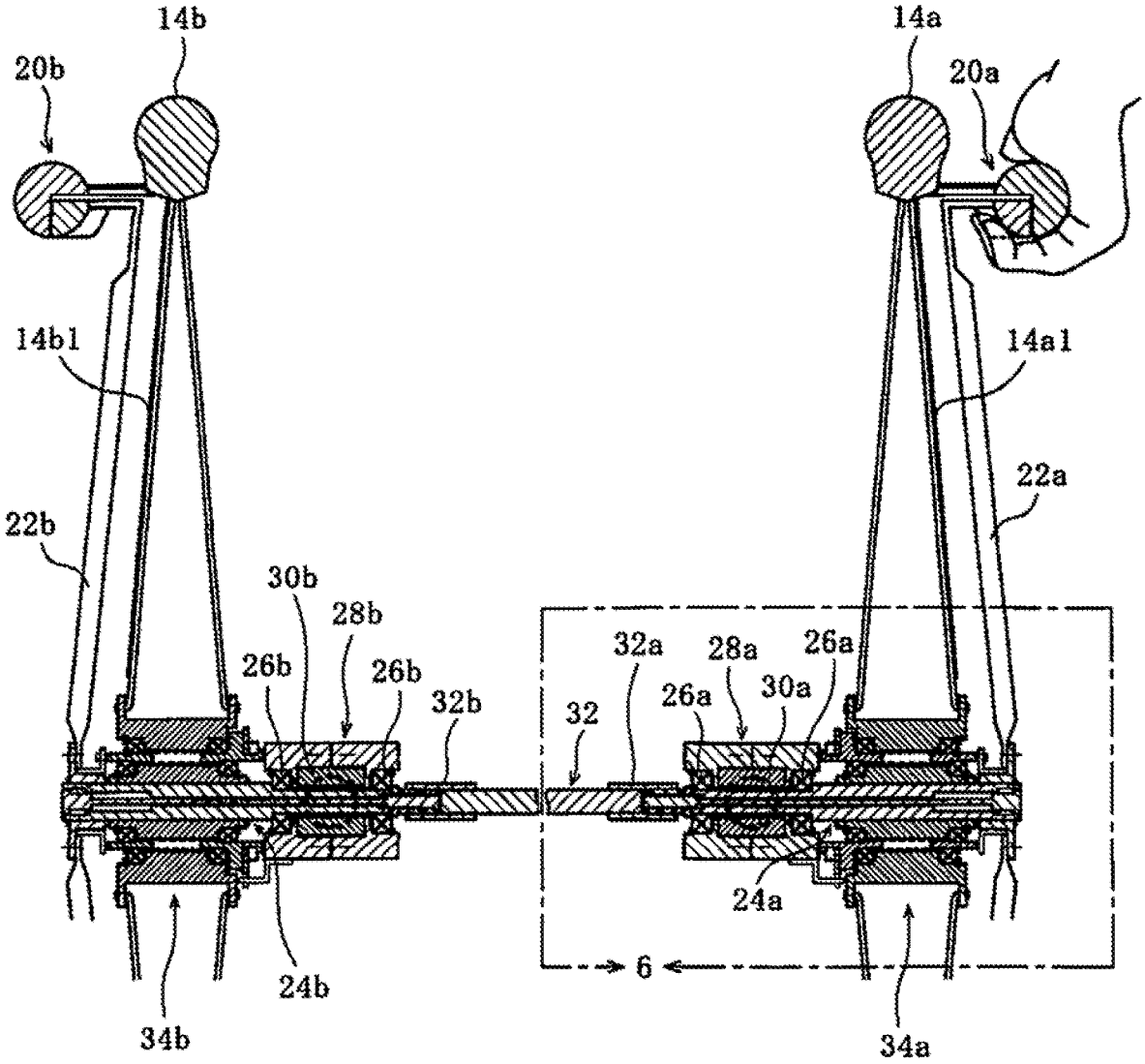
FIG. 5 is a cross-sectional view taken along line 5-5 of FIG. 1, showing a configuration of a drive mechanism of the wheelchair.
Figure 6:
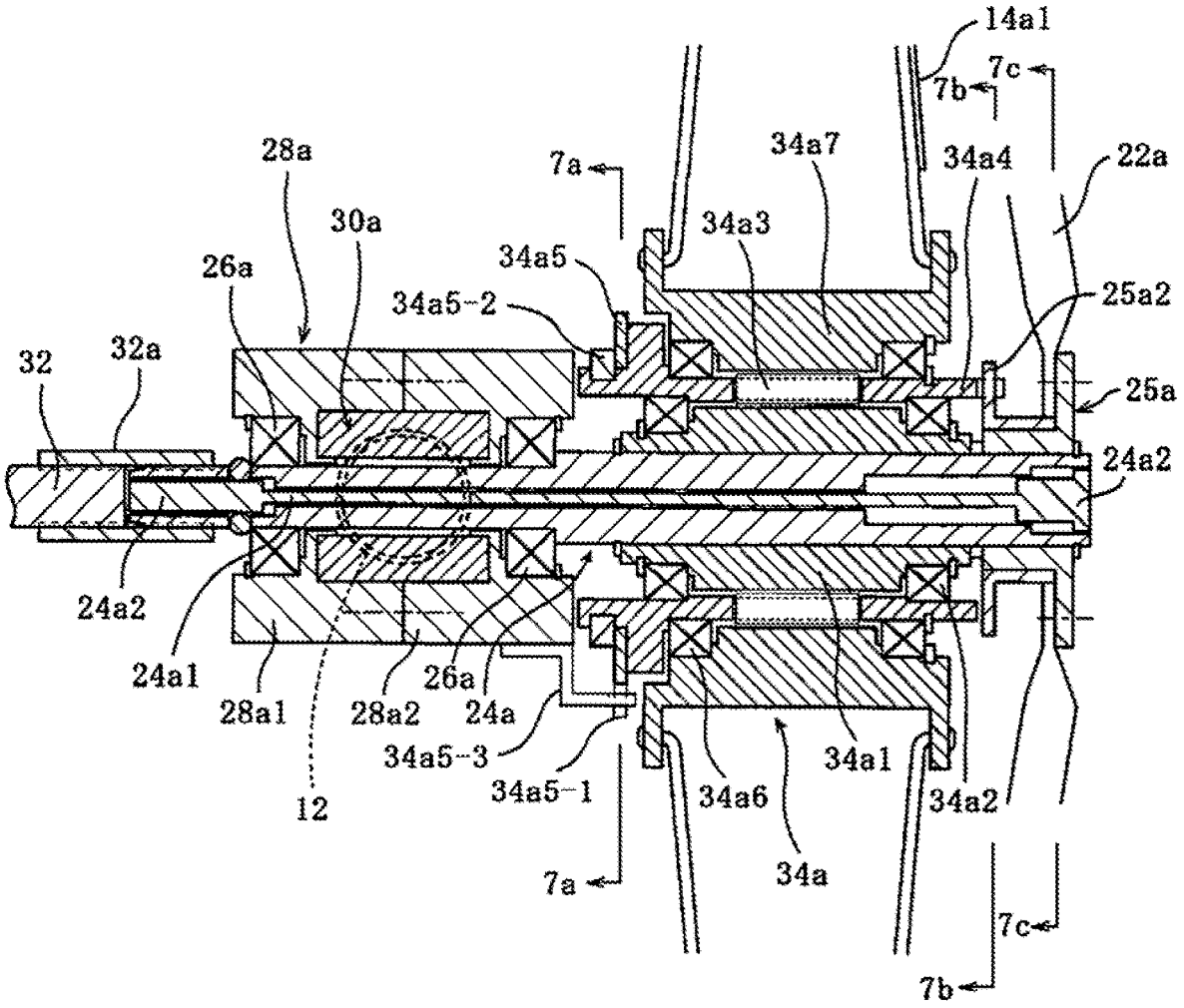
FIG. 6 is an enlarged cross-sectional view of a portion of 6 in FIG. 5.
Figure 7A:
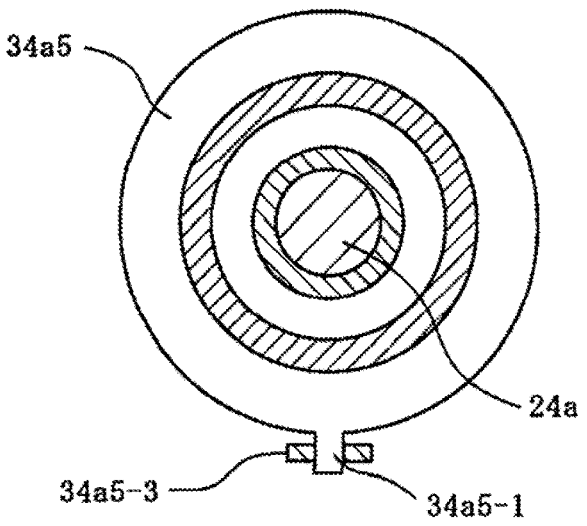
FIG. 7A is a view taken along line 7*a*-7*a* of FIG. 6.
Figure 7B:
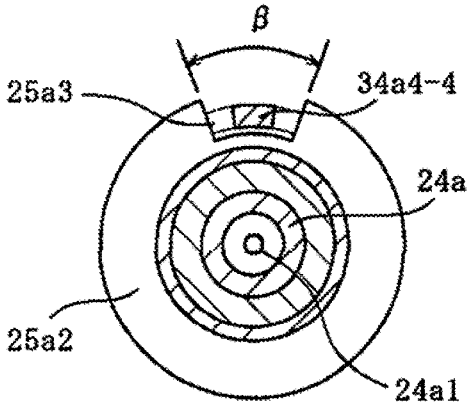
FIG. 7B is a view taken along line 7*b*-7*b* of FIG. 6.
Figure 7C:
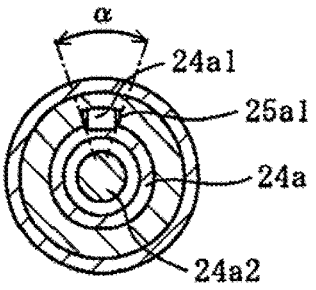
FIG. 7C is a view taken along line 7*c*-7*c* of FIG. 6.
Figure 7D:
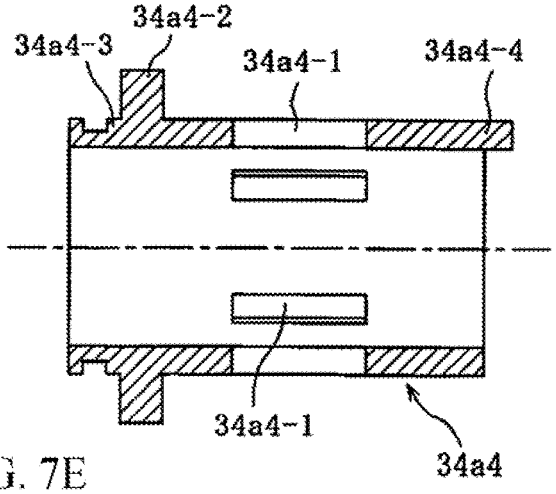
FIG. 7D is a cross-sectional view showing only a retainer taken out from FIG. 6.

Next, the configuration of the driving mechanism of the wheelchair 10 will be described with reference to FIGS. 5 to 10. FIG. 5 is a cross-sectional view taken along line 5-5 of FIG. 1, FIG. 6 is an enlarged cross-sectional view of portion 6 in FIG. 5, FIGS. 7A to 7C are views respectively taken along lines 7*a*-7*a* to 7*c*-7*c* of FIG. 6, and FIG. 8 is an enlarged isometric view of a two-way clutch 34*a* and surrounding portions shown in FIG. 6. The wheelchair 10 includes the axle 24*a* that supports the right wheel 14*a*, and the axle 24*a* is mounted to the frame 12 via an axle holder 28*a* and a mounting boss 30*a*. A receiving portion 25*a* is rotatably attached to the outer end of the axle 24*a*, and the handrim spokes 22*a* are connected to the receiving portion 25*a*. A radially extending key 24*a*1 is provided on the outer end of the axle 24*a*. The key 24*a*1 is installed on the receiving portion 25*a* and is engaged with a key groove 25*a*1 wider than the key 24*a*1 (see FIG. 7C). As a result, when the handrim spokes 22*a* are rotated, one end of the key groove 25*a*1 abuts the key 24*a*1, and the rotational force from the handrim spokes 22*a* is transmitted to the axle 24*a*. A ring-shaped control plate 25*a*2 is attached to the receiving portion 25*a*, and the control plate 25*a*2 is provided with a fan-shaped (central angle (3) notch 25*a*3 (see FIG. 7B).

The axle 24*a* is rotatably supported in the axle holder 28*a* (and therefore the frame 12) by bearings 26*a*. Also, the left side portion of the wheelchair 10 is provided with an axle 24*b* having the same configuration at the corresponding location. The axle 24*a* and the axle 24*b* form one rotating shaft via a columnar rotary shaft 32 and connection sleeves 32*a*, 32*b*.

The axle holder 28*a* shown in FIG. 6 is configured to sandwich the mounting boss 30*a* of a conventional wheelchair by a pair of holder portions 28*a*1 and 28*a*2 each having the bearing 26*a* as a retrofit attachment to the conventional wheelchair. It is possible to replace wheels 14*a* and 14*b* with wheels of the present invention while keeping the conventional wheelchair frame as it is.

In FIG. 5, for convenience of drawing, the rotary shaft 32 is shown as being right and left separated, but in actuality, the rotary shaft 32 is formed of one cylindrical shaft. Further, the axle 24*a*, the rotary shaft 32, and the axle 24*b* may be integrally formed.

In FIGS. 5 and 6, the axles 24*a* and 24*b* are hollow, and a rod 24*a*2 provided with a raised portion 24*a*3 at both ends is inserted. The rod 24*a*2 is for releasably mounting the wheel 14*a* to the frame 12. Such the configuration itself of the axle 24*a* is known and is not configured in the subject matter of the present invention.

The two-way clutch 34*a* is attached to the axle 24*a* outside the axle holder 28*a*. Here, the two-way clutch 34*a* refers to a clutch having the following functions. When inputting to the axle 24*a*, a rotational force is transmitted to an inner ring 34*a*1, but not to an outer ring 34*a*7 described later, and can be transmitted only to an outer ring 34*b*7 of a two-way clutch 34*b* on the opposite side, when inputting to the outer ring 34*a*7, a rotational force cannot be transmitted to the axle 24*a*, and when inputting to the axle 24*b*, a rotational force can be transmitted to the outer ring 34*a*7 via the rotary shaft 32, the axle 24*a* and the inner ring 34*a*1.

The two-way clutch 34*a* includes the inner ring 34*a*1 of a regular polygon (a regular hexagon in the example shown in FIG. 9A) non-rotatably attached to the axle 24*a* outside the axle holder 28*a*. The inner ring 34*a*1 is attached to the axle 24*a* by using the key groove (see FIG. 9A), press-fitting, or the like so as not to rotate. A rotation of the axle 24*a* in both directions (clockwise and counterclockwise) causes a rotation of the inner ring 34*a*1 in the same directions. Each side of the regular polygonal inner ring 34*a*1 is a cam surface, as will be described later. FIG. 10A is a view showing the two-way clutch 34*b* located on the left side of the wheelchair 10, and is similar to FIG. 9A.

Figure 9A:
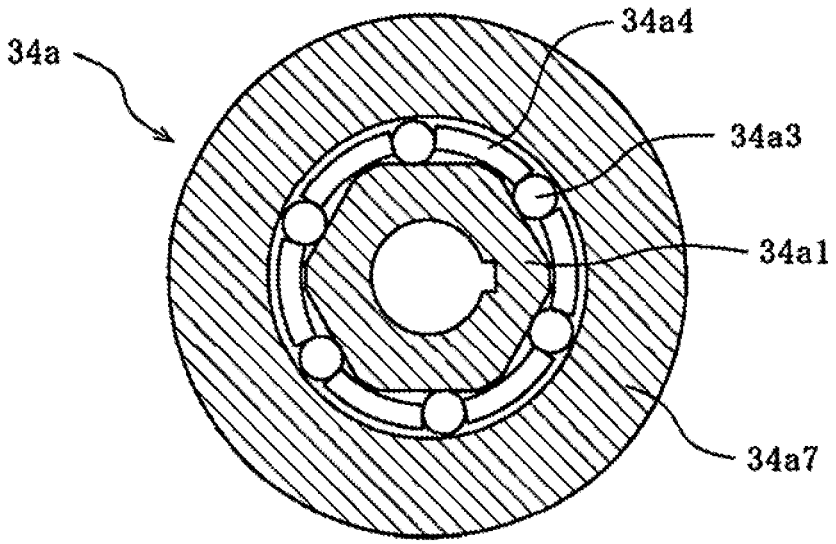
FIG. 9A is a view showing an example of the two-way clutch located on the right side of the wheelchair.
Figure 9B:
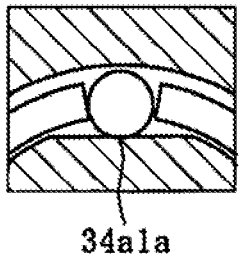
FIGS. 9B, 9C, 9D, 9E, and 9F are views showing an operating state of the two-way clutch of FIG. 9A.
Figure 9C:
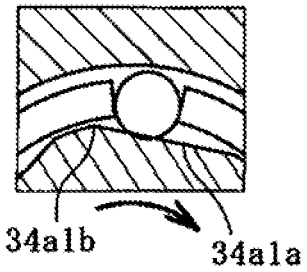
Figure 9D:
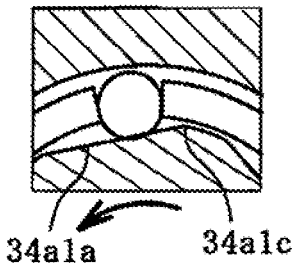
Figure 9E:
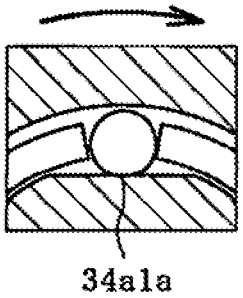
Figure 9F:
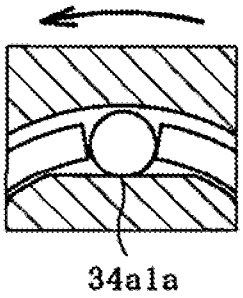
Figure 10A:
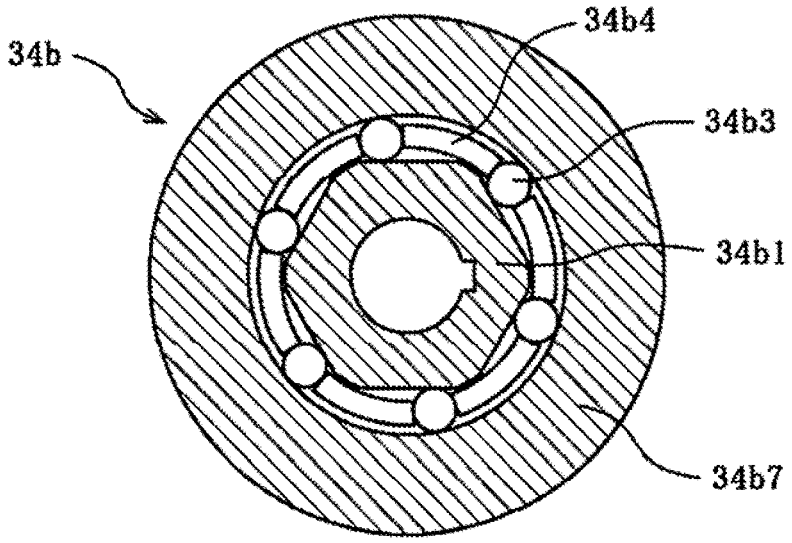
FIG. 10A is a view showing an example of the two-way clutch located on the left side of the wheelchair.
Figure 10B:
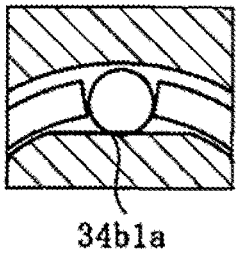
FIGS. 10B, 10C, 10D, 10E, and 10F are views showing an operating state of the two-way clutch of FIG. 10A.
Figure 10C:
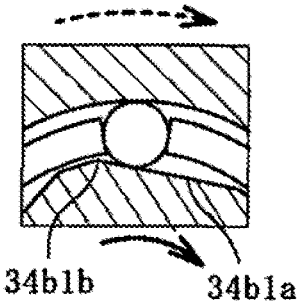

One roller 34*a*3 is respectively arranged on each side of the regular polygonal inner ring 34*a*1, as shown in FIG. 9A. Outside the inner ring 34*a*1, a retainer 34*a*4 is rotatably supported by the inner ring 34*a*1 via bearings 34*a*2 to hold the rollers 34*a*3 at a predetermined position. FIG. 7D is a cross-sectional view showing only the retainer 34*a*4 taken out from FIG. 6. The retainer 34*a*4 has a generally cylindrical shape and is provided with a respective pocket or an opening 34*a*4-1 where each the roller 34*a*3 is located. The size of the opening 34*a*4-1 is selected so that the roller 34*a*3 can be accommodated within the opening 34*a*4-1. A ring-shaped flange 34*a*4-2 is provided near the inner end of the retainer 34*a*4, and a ring-shaped step 34*a*4-3 having an outer diameter smaller than the outer diameter of the flange 34*a*4-2 is provided on the inner end surface of the flange 34*a*4-2. The flange 34*a*4-2 and the step 34*a*4-3 may be formed integrally with retainer 34*a*4 as shown, or may be formed by attaching a separate portion to retainer 34*a*4. In addition, the retainer 34*a*4 is provided with a protrusion 34*a*4-4 extending outward in the plane of the retainer 34*a*4 at one location on its outer end, and the protrusion 34*a*4-4 is engaged with the notch 25*a*3 of the control plate 25*a*2 (see FIG. 7B).

Figure 7E:
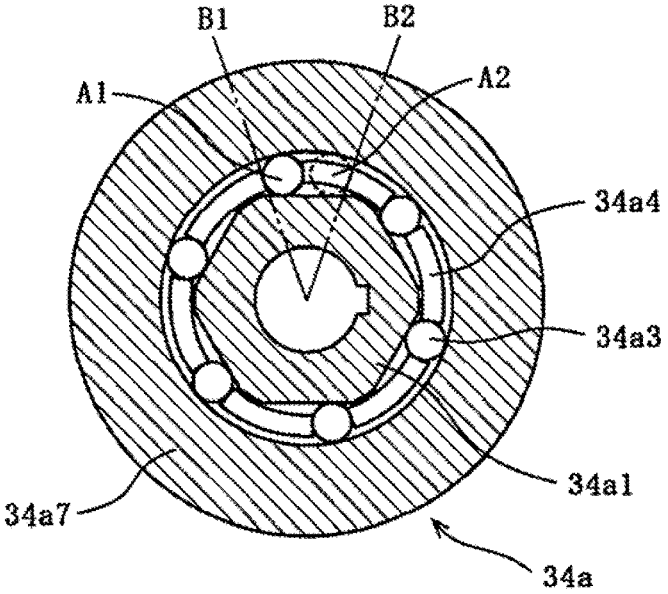
FIG. 7E is a view for explaining the size of a notch of a control plate.
Figure 8:
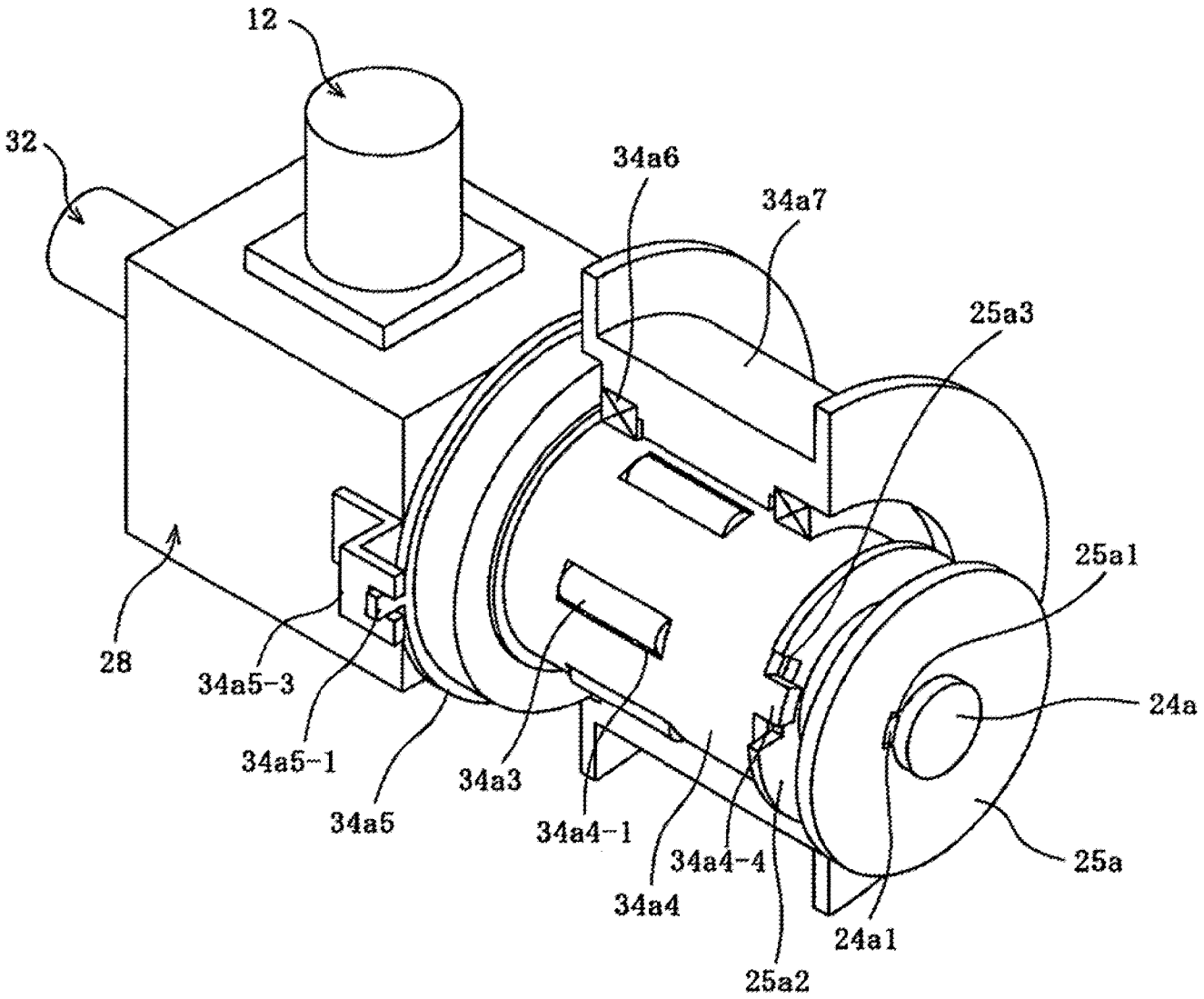
FIG. 8 is an enlarged isometric view of a two-way clutch and surrounding portions shown in FIG. 6.

FIG. 7E is a view for explaining a concept for determining the size (central angle (3) of the notch 25*a*3 of the control plate 25*a*2. The gap a (see FIG. 7C) formed by the key 24*a*1 and the key groove 25*a*1 is very small. Assuming that the key 24*a*1 abuts the one end of the key groove 25*a*1 with the gap a set to zero and the axle 24*a* and the receiving portion 25*a* rotate together, the rotation of the control plate 25*a*2 is the same as the rotation of the axle 24*a*. In FIG. 7E, A1 indicates the roller locked when the inner ring 34a1 rotates clockwise, A2 indicates the roller locked when the inner ring 34a1 rotates counterclockwise, a line B1 indicates the side surface of the opening 34a4-1 of the retainer 34a4 when the roller is positioned at A1, and a line B2 indicates the side surface of the opening 34a4-1 of the retainer 34a4 when the roller is positioned at A2. If the central angle (3 is set to be slightly larger than or equal to the angle formed by lines B1 and B2, the rotational force of the inner ring 34a1 can be transmitted to the outer ring 34a7.

A substantially ring-shaped switching plate 34a5 shown in FIG. 6 is attached to a step 34a4-3 of the retainer 34a4 (by fitting the switching plate 34a5 having an inner diameter slightly larger than the outer diameter of the step 34a4-3 into the step 34a4-3, the switching plate 34a5 is attached to retainer 34a4). In addition, the switching plate 34a5 has a radially extending protrusion 34a5-1 on its outer circumference, and the switching plate 34a5 is configured not to rotate by sandwiching the protrusion 34a5-1 with a locking portion 34a5-3 attached to the axle holder 28a (see FIG. 7A). The switching plate 34a5 is pressed against the flange 34a4-2 of the retainer 34a4 by a wave washer 34a5-2 installed in the retainer 34a4. As a result, a constant load is applied when the retainer 34a4 rotates. The switching plate 34a5 serves to provide constant resistance to the rotation of the retainer 34a4.

Outside the retainer 34a4, the outer ring 34a7 is rotatably supported by the retainer 34a4 via bearings 34a6. The outer ring 34a7 has a substantially cylindrical shape and is connected to wheel spokes 14a1 of the right wheel 14a.

The configuration of the two-way clutch 34a as described above is known (for example, a two-way clutch manufactured by NTN Corporation (English version catalog)).

In the above description, the configuration of the right side portion of the wheelchair 10 has been mainly described, but the left side portion of the wheelchair 10 also has substantially the same configuration as the right side portion. That is, when describing the main components, 20b represents a handrim, 22b represents a handrim spoke, 24b represents an axle, and 34b represents a two-way clutch.

The operation of the two-way clutches 34a and 34b configured as above will be described with reference to FIGS. 9 to 14. In FIGS. 9 and 10, solid line arrows indicate input rotations, and dashed line arrows indicate output rotations. FIGS. 11 to 14 are views showing a state of each component of the two-way clutch 34a and 34b as the handrim spokes 22a rotate, and are views showing each component of the two-way clutches 34a and 34b viewed from right side toward left side.

Figure 11:
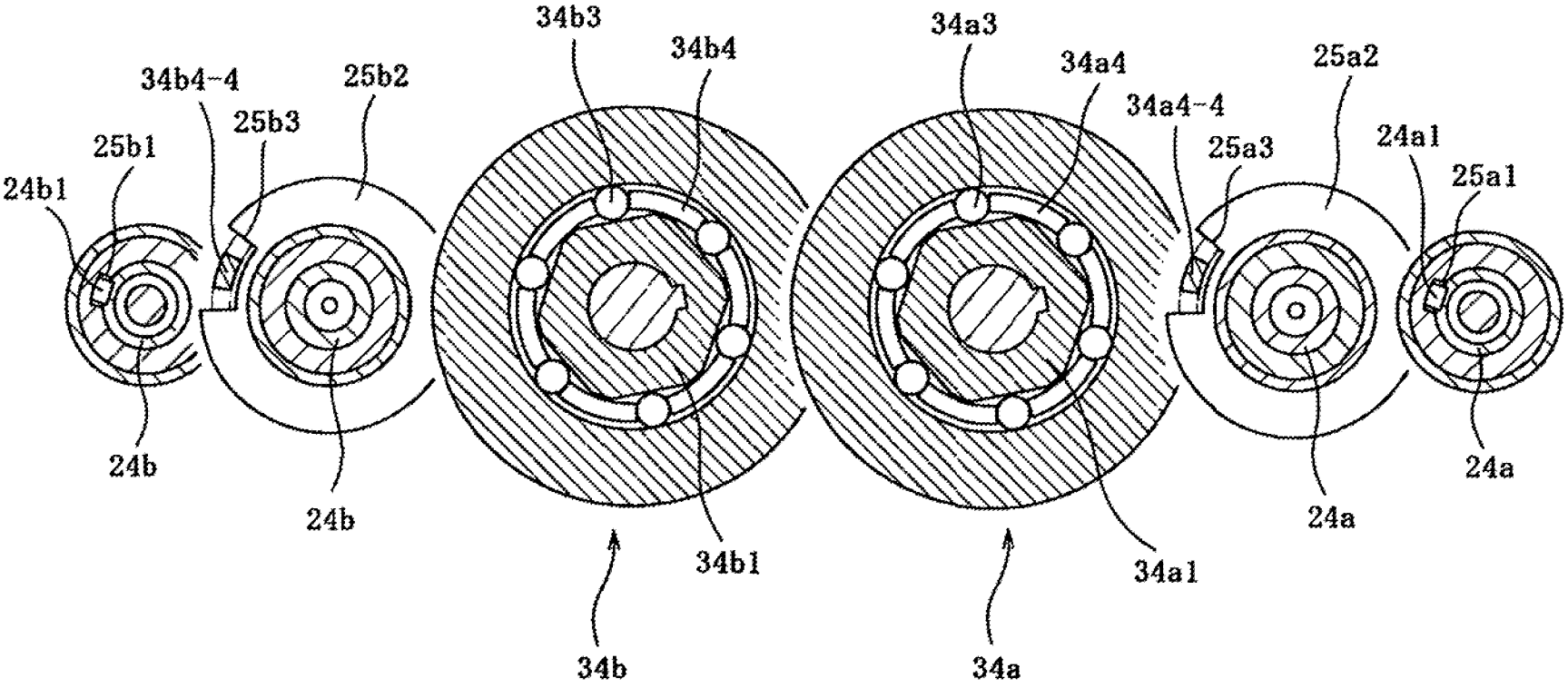
FIG. 11 is a view showing a state of each component of the two-way clutch in a neutral position.

FIG. 11 is a view showing the state of each component of the two-way clutches 34a and 34b in a neutral position. The rollers 34a3 and 34b3 are positioned at the centers of the cam surfaces of the inner ring 34a1 and an inner ring 34b1 (see FIGS. 9B and 10B). The key 24a1 and a key 24b1 of the axles 24a and 24b are positioned respectively in the centers of the key groove 25a1 and a key groove 25b1 of the receiving portion 25a and a receiving portion 25b. The protrusion 34a4-4 and a protrusion 34b4-4 of retainers 34a4 and 34b4 are positioned respectively in the centers of the notch 25a3 and a notch 25b3 of the control plate 25a2 and a control plate 25b2.

Figure 12:
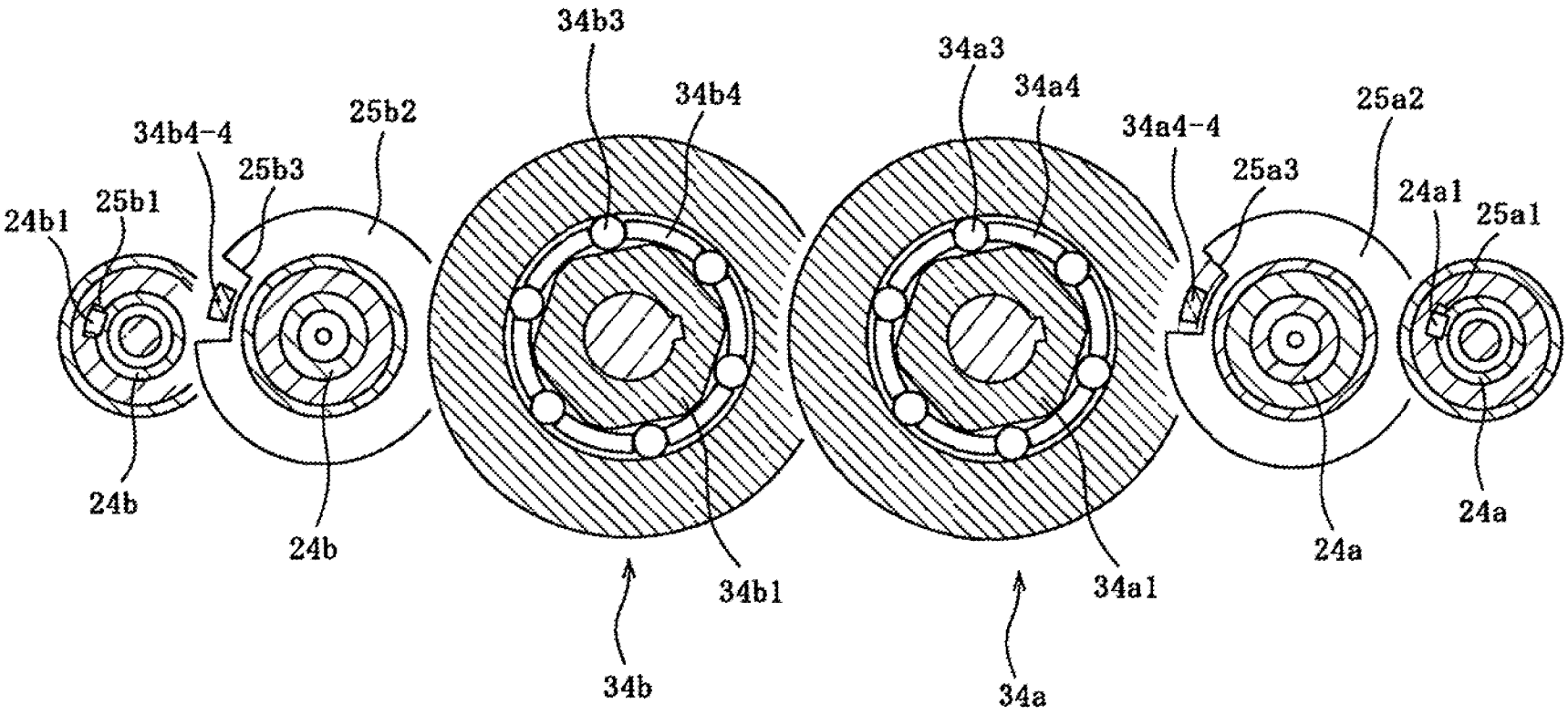
FIG. 12 is a view showing a state of each component of the two-way clutch at a first time point.

FIG. 12 is a view showing a state of each component of the two-way clutches 34a and 34b at a first time point. The first time point is the moment when the handrim spokes 22a (and thus the receiving portion 25a) rotate clockwise and the one end of the key groove 25a1 abuts the key 24a1. At the first time point, the axle 24a has not yet rotated, but the control plate 25a2 attached to the receiving portion 25a rotates in the same direction. Since the width (central angle) R of the notch 25a3 is larger than the angle α, at the first point of time, the notch 25a3 does not abut the protrusion 34a4-4 of the retainer 34a4, and the rotational force is not transmitted to the retainer 34a4. When the receiving portion 25a further rotates clockwise from the first time point, the rotational force is transmitted to the axle 24a via the key 24a1, and the axle 24a also rotates in the same direction.

Figure 13:
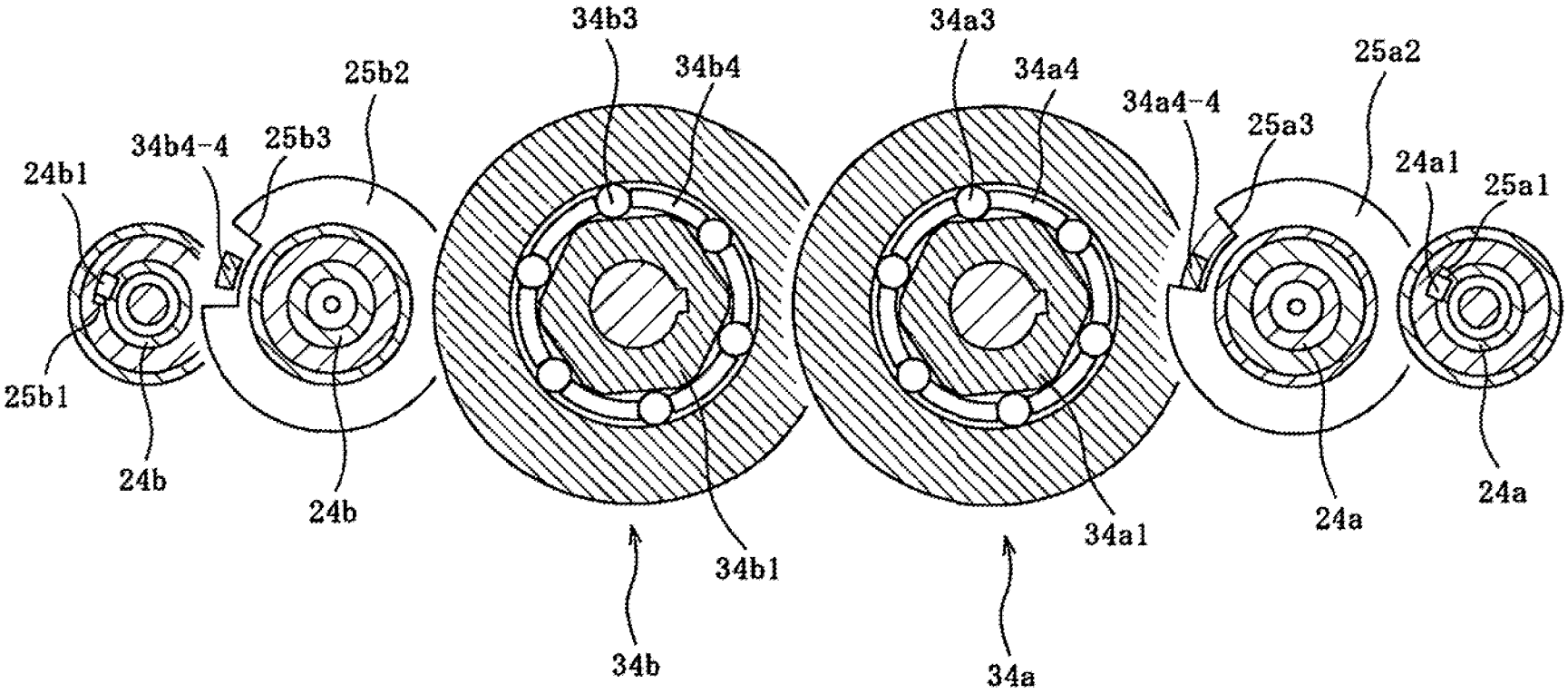
FIG. 13 is a view showing a state of each component of the two-way clutch at a second time point.

FIG. 13 is a view showing a state of each component of the two-way clutch at a second time point. The second time point is the moment when the handrim spokes 22a (and thus, the receiving portion 25a) rotate further clockwise from the first time point and one end of the notch 25a3 abuts the protrusion 34a4-4. At the second time point, the rotational force of the axle 24a is transmitted to the axle 24b via the rotary shaft 32, so that the axle 24b also rotates in the same direction, and the key 24b1 abuts one end of the key groove 25b1. At the second time point, the inner rings 34a1 and 34b1 rotate respectively via the axles 24a and 24b, but the control plate 25b2 does not yet rotate. The retainers 34a4 and 34b4, the rollers 34a3 and 34b3 (located between left end portions 34a1b (see FIG. 9C) and 34b1b (see FIG. 10C), and intermediate portions 34a1a and 34b1a of each side of the cam surfaces of the inner rings 34a1 and 34b1), and the outer rings 34a7 and 34b7 do not rotate either.

Figure 14:
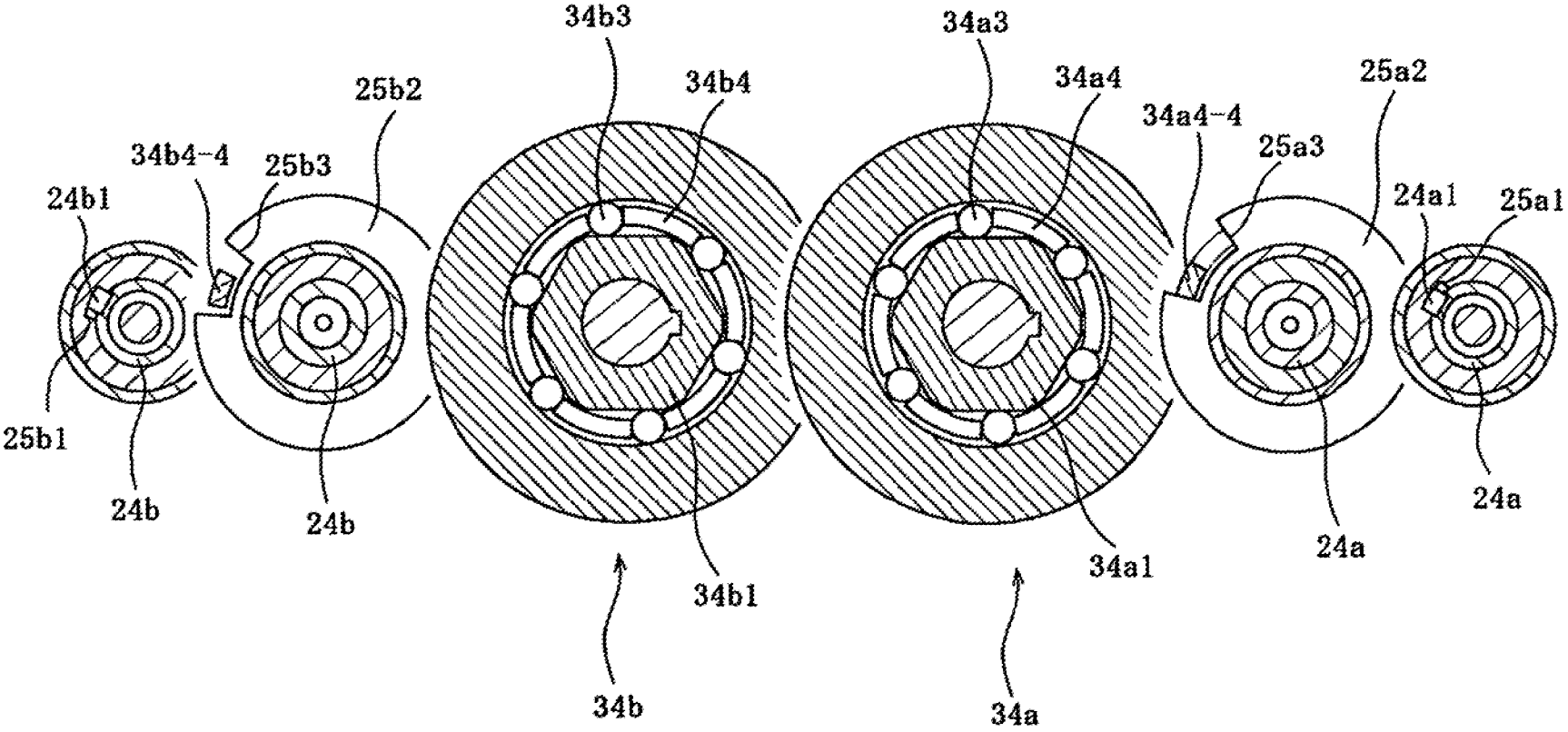
FIG. 14 is a view showing a state of each component of the two-way clutch at a third time point.

FIG. 14 is a view showing a state of each component of the two-way clutches 34a and 34b at a third time point. The third time point is the moment when the handrim spokes 22a (and thus, the receiving portion 25a) rotate further clockwise from the second time point. This is the time before the rollers 34b3 are locked by the rotation as will be described later, and this is the time before one end of the notch 25b3 abuts the protrusion 34b4-4. At the third time point, the two-way clutch 34a and the two-way clutch 34b operate differently.

That is, in the two-way clutch 34a, the inner ring 34a1 rotates, and the rotation of the control plate 25a2 causes the retainer 34a4 to rotate in the same direction. The rollers 34a3 are located between the left end portions 34a1b and the intermediate portions 34a1a (same position as in FIG. 13) of the sides of the cam surfaces of the inner ring 34a1. Therefore, the rotational force of the inner ring 34a1 is not transmitted to the outer ring 34a7.

On the other hand, in the two-way clutch 34b, the inner ring 34b rotates, but the control plate 25b2 does not rotate because it is the third time point before the one end of the notch 25b3 abuts the protrusion 34b4-4 as described above. Therefore, the retainer 34b4 does not rotate either. When the inner ring 34b1 rotates clockwise, the rollers 34b3 move from positions between the intermediate portions 34b1a and the left end portions 34b1b on the side of the cam surfaces of the inner ring 34b1 to the left end portions 34b1b (during this period, the rotational force of the inner ring 34b1 is not transmitted to the outer ring 34b7). When the rollers 34b3 reach the left end portions 34b1b, the rotation of the rollers 34b3 is locked (see FIG. 10C), the rotational force of the inner ring 34b1 (solid line arrow in FIG. 10C) is transmitted to the outer ring 34b7, and the outer ring 34b7 rotates clockwise (dashed line arrow in FIG. 10C). When the receiving portion 25a rotates counterclockwise and the inner ring 34b1 rotates counterclockwise, the rollers 34b3 move from positions between the intermediate portions 34b1a and the right end portions 34b1c of the side of the cam surfaces of the inner ring 34b1 to the right end portions 34b1c (during this period, the rotational force of the inner ring 34b1 is not transmitted to the outer ring 34b7). When the rollers 34b3 reach the right end portions 34b1c, the rotation of the rollers

Figure 10D:
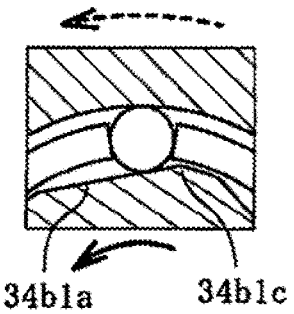
Figure 10E:
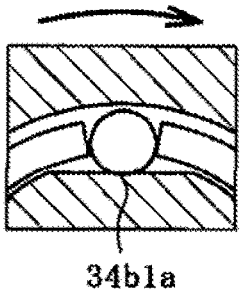
Figure 10F:
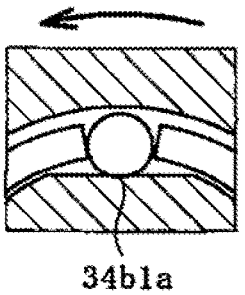

34*b*3 is locked (see FIG. 10D), the rotational force of the inner ring 34*b*1 (solid line arrow in FIG. 10D) is transmitted to the outer ring 34*b*7, and the outer ring 34*b*7 rotates counterclockwise (dashed line arrow in FIG. 10D).

As described above, by setting a time difference in the rotation of each component (the axles 24*a* and 24*b*, the inner rings 34*a*1 and 34*b*1, the control plates 25*a*2 and 25*b*2, the retainers 34*a*4 and 34*b*4) caused by the rotation of the handrim spokes 22*a*, it is configured so that the rotational force is not transmitted, to the right wheel 14*a* on the same side as the handrim spokes 22*a*, but is transmitted to the left wheel 14*b* on the opposite side. That is, when the handrim spokes 22*a* are rotated, the axle 24*a* rotates after a short period of time (the one end of the key groove 25*a*1 abuts the key 24*a*1), and the axle 24*b* also rotates via the rotary shaft 32. When the axles 24*a*, 24*b* rotate, the inner rings 34*a*1 and 34*b*1 non-rotatably attached to the axles 24*a* and 24*b* also rotate. When the handrim spokes 22*a* are further rotated, after a certain period of time has elapsed (the one end of the notch 25*a*3 abuts the protrusion 34*a*4-4), and when the control plate 25*a*2 rotates, the retainer 34*a*4 also begins to rotate. However, since 25*b*2 does not rotate, the retainer 34*b*4 does not rotate. When the retainer 34*a*4 rotates, the rotation of the inner ring 34*a*1 is not transmitted to the outer ring 34*a*7 because the rollers 34*a*3 are not locked. On the other hand, since the retainer 34*b*4 does not rotate, the rollers 34*b*3 are locked and the rotation of the inner ring 34*b*1 is transmitted to the outer ring 34*b*7.

When the second portions 20*a*2 and 20*b*2 of the handrims 20*a* and 20*b* are grasped and rotated, the rotational force is transmitted to the outer rings 34*a*7 and 34*b*7 of the two-way clutches 34*a* and 34*b*. When the outer rings 34*a*7 and 34*b*7 rotate clockwise (solid line arrows in FIGS. 9E and 10E), the inner surfaces of the outer rings 34*a*7 and 34*b*7 are not cam surfaces but circular surfaces, so that the rotational forces of the outer rings 34*a*7 and 34*b*7 are not transmitted to the inner rings 34*a*1 and 34*b*1, and the inner rings 34*a*1 and 34*b*1 do not rotate. When the outer rings 34*a*7 and 34*b*7 rotate counterclockwise (solid line arrows in FIGS. 9F and 10F), the inner surfaces of the outer rings 34*a*7 and 34*b*7 are not cam surfaces but circular surfaces, so that the rotational forces of the outer rings 34*a*7 and 34*b*7 are not transmitted to the inner rings 34*a*1 and 34*b*1, and the inner rings 34*a*1 and 34*b*1 do not rotate.

If it operates similarly to the two-way clutches 34*a* and 34*b* as described above, the two-way clutches of another configuration may be adopted.

The operation of the wheelchair 10 provided with the two-way clutches 34*a* and 34*b* will be described with reference to FIGS. 15A to 15D,16A, and 16B. FIGS. 15A to 15D are schematic plan views showing straight movements, a left turn movement, and a right turn movement of the wheelchair. FIGS. 16A and 16B are schematic plan views showing the right turn movement and the left turn movement of the wheelchair.

Figure 15A:
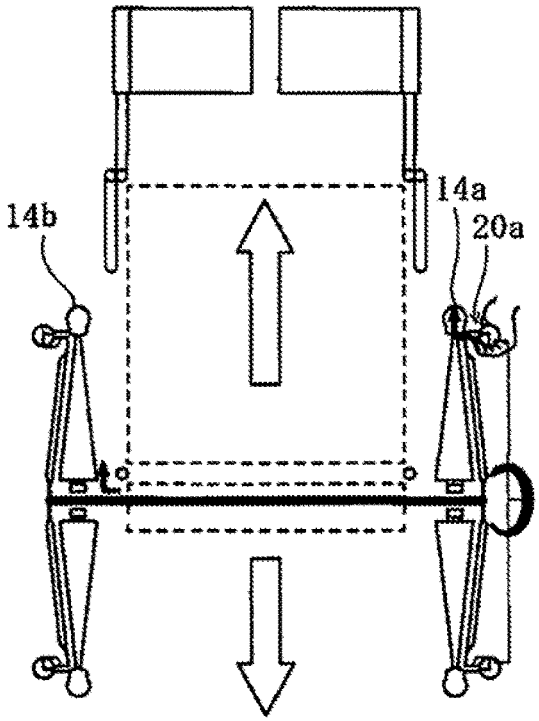
FIGS. 15A to 15D are schematic plan views showing straight movements, a left turn movement, and a right turn movement of the wheelchair.
Figure 16A:
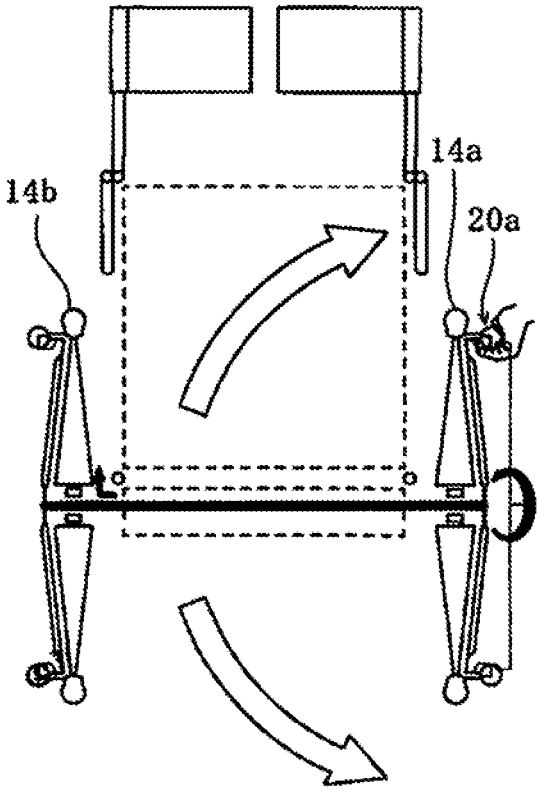
FIGS. 16A and 16B are schematic plan views showing the right turn movement and the left turn movement of the wheelchair.
Figure 16B:
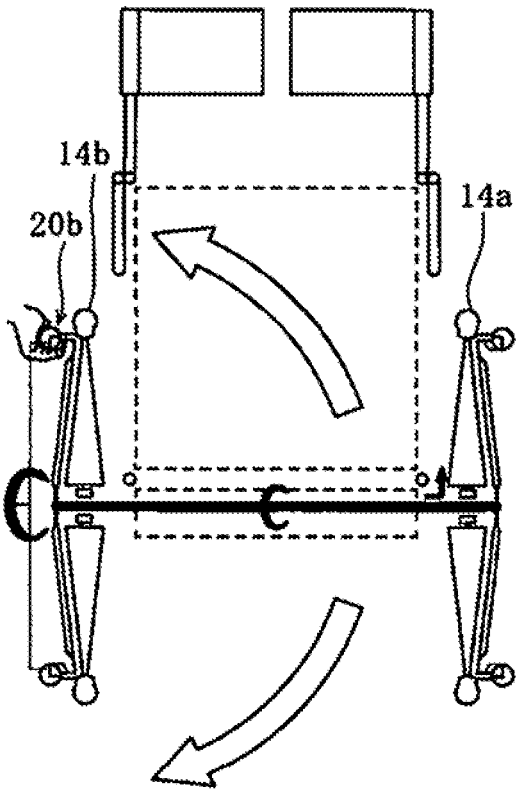

When attempting to move straight (forward or backward) by the right hand, both the first portion 20*a*1 and the second portion 20*a*2 of the handrim 20*a* are grasped by the right hand and are rotated forward or backward (see FIG. 15A). Then, a rotational force of the first portion 20*a* causes the transmission to the axle 24*a*, the rotary shaft 32, the axle 24*b*, and the two-way clutch 34*b* via the handrim spokes 22*a*, and causes the transmission to the outer ring 34*b*7 to rotate the left wheel 14*b* forward or backward. At the same time, a rotational force of the second portion 20*a* causes the transmission directly to the corresponding wheel (right wheel 14*a*). (At that time, even if the outer ring 34*a*7 of the two-way clutch 34*a* rotates, the inner ring 34*a*1 does not rotate). As the right wheel 14*a* is rotated forward or backward, the wheelchair 10 moves forward or backward.

Figure 15B:
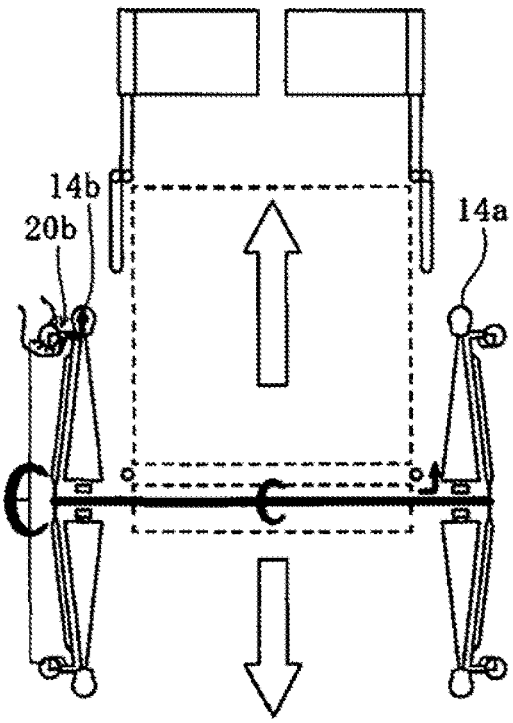

When attempting to move straight (forward or backward) by the left hand, both the first portion 20*a*1 and the second portion 20*a*2 of the handrim 20*a* are grasped by the left hand and are rotated forward or backward (see FIG. 15B). Then, a rotational force of the first portion 20*b* causes the transmission to the axle 24*b*, the rotary shaft 32, the axle 24*a*, and the two-way clutch 34*a* via the handrim spokes 22*b*, and causes the transmission to the outer ring 34*a*7 to rotate the right wheel 14*a* forward or backward. At the same time, a rotational force of the second portion 20*b* causes the transmission directly to the corresponding wheel (left wheel 14*b*). (At that time, even if the outer ring 34*b*7 of the two-way clutch 34*b* rotates, the inner ring 34*b*1 does not rotate). As the left wheel 14*b* is rotated forward or backward, the wheelchair 10 moves forward or backward.

Figure 15C:
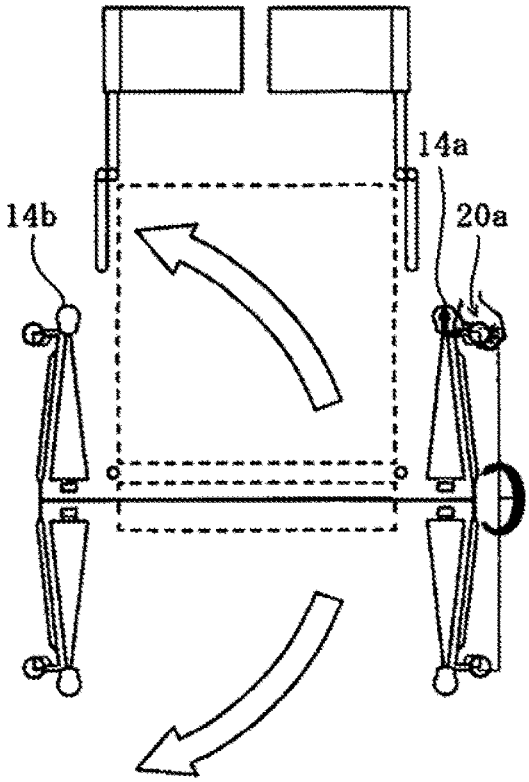

When attempting to turn left (forward or backward) with the right hand, only the second portion 20*a*2 of the handrim 20*a* is grasped by the right hand and is rotated forward or backward (see FIG. 15C). Then, the rotational force of the second portion 20*a* causes the transmission directly to the corresponding wheel (right wheel 14*a*). (At that time, even if the outer ring 34*a*7 of the two-way clutch 34*a* rotates, the inner ring 34*a*1 does not rotate). As the right wheel 14*a* is rotated forward or backward while the left wheel 14*b* is not rotated, the wheelchair 10 turns left (forward or backward).

Figure 15D:
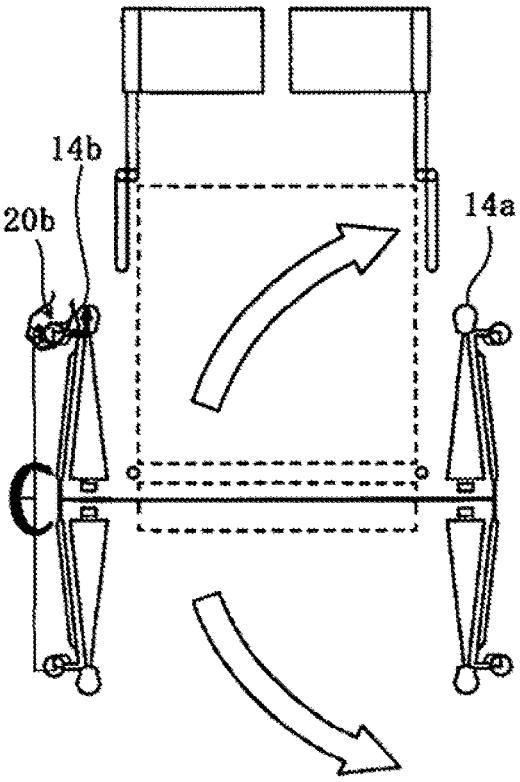

When attempting to turn right (forward or backward) by the left hand, only the second portion 20*b*2 of the handrim 20*b* is grasped by the left hand and is rotated forward or backward (see FIG. 15D). Then, the rotational force of the second portion 20*b* causes the transmission directly to the corresponding wheel (left wheel 14*b*). (At that time, even if the outer ring 34*b*7 of the two-way clutch 34*b* rotates, the inner ring 34*b*1 does not rotate). As the left wheel 14*b* is rotated forward or backward while the right wheel 14*a* is not rotated, the wheelchair 10 turns right (forward or backward).

When attempting to turn right (forward or backward) by the right hand, only the first portion 20*a*1 of the handrim 20*a* is grasped by the right hand and is rotated forward or backward (see FIG. 16A). Then, the rotational force of the first portion 20*a*1 is transmitted to the axle 24*a*, the rotary shaft 32, the axle 24*b*, and the two-way clutch 34*b* via the handrim spokes 22*a*, and is transmitted to the outer ring 34*b*7 to rotate the left wheel 14*b*. As the left wheel 14*b* is rotated forward or backward while the right wheel 14*a* is not rotated, the wheelchair 10 turns right (forward or backward).

When attempting to turn left (forward or backward) by the left hand, only the first portion 20*b*1 of the handrim 20*b* is grasped by the left hand and is rotated forward or backward (see FIG. 16A). Then, the rotational force of the first portion 20*b*1 is transmitted to the axle 24*b*, the rotary shaft 32, the axle 24*a*, and the two-way clutch 34*a* via the handrim spokes 22*a*, and is transmitted to the outer ring 34*a*7 to rotate the right wheel 14*a*. As the right wheel 14*a* is rotated forward or backward while the left wheel 14*b* is not rotated, the wheelchair 10 turns left (forward or backward).

By changing the two portions of the handrims 20*a* and 20*b* by the right and left hands, it is possible to comfortably perform an uphill movement. That is, for example, first, the two portions of the handrims 20*a* and 20*b* are grasped by both hands and rotated forward to perform the uphill movement. When rowing once and then stopping, it is enough to grasp both the first portion 20*a*1 and the second portion 20*a*2 of the handrim 20*a* by the right hand without rotating. Next, the left hand is separated from the first portion 20*b*1 and the second portion 20*b*2 of the handrim 20*b* and returned to the first rowing position, and both the first portion 20*b*1 and the second portion 20*b*2 of the handrim 20*b* are grasped without the rotation by the left hand to keep the stop. Next, the right hand is separated from the first portion 20*a*1 and the second portion 20*a*2 of the handrim 20*a* and returned to the first rowing position, and both the first portion 20*a*1 and the second portion 20*a*2 of the handrim 20*a* are grasped without the rotation by the right hand to keep the stop. While grasping the two portions of the handrims 20*a* and 20*b* by both hands, the handrims are rotated forward to perform the uphill movement. This series of operations are repeated to perform the uphill movement. In this way, by changing the right and left hands and operating, unlike the conventional both-hands-operated wheelchair, it is possible to perform the uphill movement while resting according to the physical strength of the user.

In the above description, the right side portion of the wheelchair 10 has been described, but the left side portion is the same as the right side portion.

It is needless to say that the present invention is not limited to the above-described embodiments, various modifications can be made within the scope of the invention described in the claims, and these are also included in the scope of the present invention.

For example, the details of the components of the wheelchair shown are merely exemplary and these details may be modified.

DESCRIPTION OF THE REFERENCE NUMERALS

10 wheelchair
12 frame
14*a*, 14*b* wheel
14*a*1, 14*b*1 wheel spoke
16*a*, 16*b* caster
18 seat
20*a*, 20*b* handrim
20*a*1, 20*b*1 first portion
20*a*2, 20*b*2 second portion
20*a*3, 20*b*3 convex portion
22*a*, 22*b* handrim spoke
24*a*, 24*b* axle
24*a*1, 24*b*1 key
24*a*2, 24*b*2 rod
24*a*3, 24*b*3 raised portion
25*a*, 25*b* receiving portion
25*a*1, 25*b*1 key groove
25*a*2, 25*b*2 control plate
25*a*3, 25*b*3 notch
26*a*, 26*b* bearing
28*a*, 28*b* axle holder
30*a*, 30*b* mounting boss
32 rotary shaft
32*a*, 32*b* connection sleeve
34*a*, 34*b* two-way clutch
34*a*1, 34*b*1 inner ring
34*a*1*a*, 34*b*1*a* intermediate portion of each side of cam surface
34*a*1*b*, 34*b*1*b* left end portion of each side of cam surface
34*a*1*c*, 34*b*1*c* right end portion of each side of cam surface
34*a*2, 34*b*2 bearing
34*a*3, 34*b*3 roller
34*a*4, 34*b*4 retainer
34*a*4-1, 34*b*4-1 opening
34*a*4-2, 34*b*4-2 flange
34*a*4-3, 34*b*4-3 step
34*a*4-4, 34*b*4-4 protrusion
34*a*5, 34*b*5 switching plate
34*a*5-1, 34*b*5-1 protrusion
34*a*5-2, 34*b*5-2 wave washer
34*a*5-3, 34*b*5-3 locking portion
34*a*6, 34*b*6 bearing
34*a*7, 34*b*7 outer ring

What is claimed is:

1. A wheelchair having a frame, a right wheel and a left wheel, a right caster and a left caster, a seat, and a pair of right and left circular cross-sectional handrims concentrically disposed with an axle of each wheel, the wheelchair comprising:

each of the handrims formed as separate bodies, and having a first portion located at an inner lower portion of the circular cross-section and a second portion occupying a portion other than the first portion of the circular cross-section;

the first portion connected to handrim spokes;

the second portion connected to a base of each wheel; and a drive mechanism for transmitting a first rotational force generated by the first portion of the handrim on one side to the wheel on another side, and for transmitting a second rotational force generated by the first portion of the handrim on the other side to the wheel on the one side, wherein a third rotational force generated by the second portion of the handrim on the one side and/or the other side is transmitted to the wheel on the corresponding side, the drive mechanism has the axle on the one side connected to the handrim spokes on the one side, the axle on the other side connected to the axle on the one side via a rotary shaft and connected to the handrim spokes on the other side, a first two-way clutch disposed on the axle on the one side, and a second two-way clutch disposed on the axle on the other side, the first two-way clutch is configured to transmit the second rotational force to the wheel on the one side, is configured not to transmit the first rotational force to the axle on the one side, and is configured not to transmit the third rotational force generated by the second portion of the handrim on the one side to the axle on the one side, and the second two-way clutch is configured to transmit the first rotational force to the wheel on the other side, is configured not to transmit the second rotational force to the axle on the other side, and is configured not to transmit the third rotational force generated by the second portion of the handrim on the other side to the axle on the other side.

2. The wheelchair according to claim 1, wherein a first key provided on the outer end of the axle on the one side is installed on a first receiving portion rotatably attached to the outer end of the axle on the one side, and is engaged with a first key groove wider than the first key, a second key provided on the outer end of the axle on the other side is installed on a second receiving portion rotatably attached to the outer end of the axle on the other side, and is engaged with a second key groove wider than the second key, by rotating the receiving portion connected to the handrim spokes on the corresponding side and had a control plate with a notch, the rotational force from the handrim spokes on the corresponding side is transmitted to the axle on the corresponding side, the first two-way clutch has first rollers for cutting off transmission of the first rotational force or for carrying out transmission of the second rotational force between the axle on the one side and the wheel on the one side, and has a first retainer for retaining the first rollers at a predetermined location, the second two-way clutch has second rollers for cutting off transmission of the second rotational force or for carrying out transmission of the first rotational force between the axle on the other side and the wheel on the other side, and has a second retainer for retaining the second rollers at a predetermined location, by rotating the control plate by rotating the first receiving portion, and by rotating the first retainer by engaging the notch with a protrusion provided on the first retainer, the first rotational force is not transmitted from the axle on the one side to the wheel on the one side without locking the rotation of the first rollers, and the first rotational force is transmitted from the axle on the other side to the wheel on the other side, and by rotating the control plate by rotating the second receiving portion, and by rotating the second retainer by engaging the notch with a protrusion provided on the second retainer, the second rotational force is not transmitted from the axle on the other side to the wheel on the other side without locking the rotation of the second rollers, and the second rotational force is transmitted from the axle on the one side to the wheel on the one side.

* * * * *